US011879197B2

(12) United States Patent
Lee et al.

(10) Patent No.: US 11,879,197 B2
(45) Date of Patent: Jan. 23, 2024

(54) LAUNDRY TREATING APPARATUS

(71) Applicant: LG Electronics Inc., Seoul (KR)

(72) Inventors: Jihong Lee, Seoul (KR); Kwanwoong Jeong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 283 days.

(21) Appl. No.: 17/299,946

(22) PCT Filed: Nov. 28, 2019

(86) PCT No.: PCT/KR2019/016584
§ 371 (c)(1),
(2) Date: Jun. 4, 2021

(87) PCT Pub. No.: WO2020/116859
PCT Pub. Date: Jun. 11, 2020

(65) Prior Publication Data

US 2022/0064840 A1 Mar. 3, 2022

(30) Foreign Application Priority Data

Dec. 7, 2018 (KR) ..... 10-2018-0157120

(51) Int. Cl.
*D06F 34/20* (2020.01)
*D06F 37/18* (2006.01)
(Continued)

(52) U.S. Cl.
CPC ..... *D06F 34/20* (2020.02); *D06F 29/005* (2013.01); *D06F 31/00* (2013.01); *D06F 37/18* (2013.01);
(Continued)

(58) Field of Classification Search
CPC ..... D06F 34/20; D06F 29/005; D06F 31/00; D06F 37/18; D06F 37/28; D06F 37/30;
(Continued)

(56) References Cited

U.S. PATENT DOCUMENTS 6,732,552 B2 5/2004 Kim et al.
2017/0002494 A1* 1/2017 Lee ..... D06F 39/00
(Continued)

FOREIGN PATENT DOCUMENTS

CA 2893188 A1 11/2015
CN 104420122 A 3/2015
(Continued)

OTHER PUBLICATIONS

International Search Report and Written Opinion of the International Searching Authority for International Application No. PCT/KR2019/016584 dated Mar. 16, 2020 (11 pages).

*Primary Examiner* — David G Cormier
*Assistant Examiner* — Thomas Bucci
(74) *Attorney, Agent, or Firm* — Birch, Stewart, Kolasch & Birch, LLP

(57) ABSTRACT

The present application proposes a laundry treating apparatus comprising: a cabinet; a drawer; a drum; a laundry inlet; a housing; a lever body; a body pressing portion; a magnetic field generator; a magnetic field sensor; a contact body; a slide wherein when an object contacts the contact body, the slide moves the free end of the lever body so that a distance between the magnetic field generator and the magnetic field sensor is equal to or smaller than a reference distance; and a door pivotably mounted on the top face of the drawer or a top face of the tub, wherein when the door pivots in a direction of opening the laundry inlet while the drawer is inserted into the cabinet, the door presses the body pressing portion such that a distance between the magnetic field
(Continued)

generator and the magnetic field sensor is larger than the reference distance.

18 Claims, 7 Drawing Sheets

(51) Int. Cl.

| | |
|---|---|
| ***D06F 37/28*** | (2006.01) |
| ***D06F 37/30*** | (2020.01) |
| ***D06F 39/14*** | (2006.01) |
| ***D06F 29/00*** | (2006.01) |
| ***D06F 31/00*** | (2006.01) |
| ***D06F 37/42*** | (2006.01) |
| *D06F 105/46* | (2020.01) |
| *D06F 103/40* | (2020.01) |

(52) U.S. Cl.
CPC ..... *D06F 37/28* (2013.01); *D06F 37/30* (2013.01); *D06F 37/42* (2013.01); *D06F 39/14* (2013.01); *D06F 2103/40* (2020.02); *D06F 2105/46* (2020.02)

(58) Field of Classification Search
CPC ..... D06F 37/42; D06F 39/14; D06F 2103/40; D06F 2105/46; D06F 23/04; D06F 39/125; D06F 2105/44; E05Y 2900/312; Y02B 40/00
USPC ..... 68/27
See application file for complete search history.

(56) References Cited

U.S. PATENT DOCUMENTS

| | | | | |
|---|---|---|---|---|
| 2017/0002498 | A1* | 1/2017 | Lee | D06F 34/20 |
| 2017/0002504 | A1* | 1/2017 | Jung | D06F 37/02 |
| 2017/0356117 | A1* | 12/2017 | Lee | D06F 39/12 |
| 2018/0023241 | A1* | 1/2018 | Lee | E05C 19/16 312/333 |
| 2018/0100258 | A1* | 4/2018 | Sang | D06F 29/005 |
| 2018/0119326 | A1* | 5/2018 | Jung | D06F 29/005 |
| 2018/0340285 | A1* | 11/2018 | Choi | D06F 31/00 |

FOREIGN PATENT DOCUMENTS

| | | | |
|---|---|---|---|
| CN | 108319820 | A | 1/2017 |
| EP | 3 112 515 | A1 | 1/2017 |
| EP | 3 112 516 | A1 | 1/2017 |
| EP | 3 112 523 | A1 | 1/2017 |
| GB | 260393 | | 11/1926 |
| KR | 10-0400445 | B1 | 10/2003 |
| KR | 10-2010-0117972 | A | 11/2010 |
| KR | 10-2018-0023289 | A | 3/2018 |
| WO | WO 2017/003170 | A1 | 1/2017 |
| WO | WO 2020/085695 | A1 | 4/2020 |

* cited by examiner

LAUNDRY TREATING APPARATUS

CROSS-REFERENCE TO RELATED APPLICATIONS

This application is a U.S. National Phase of PCT International Application No. PCT/KR2019/016584, filed on Nov. 28, 2019, which claims priority under 35 U.S.C. 119(a) to Patent Application No. 10-2018-0157120, filed in the Republic of Korea on Dec. 7, 2018, the contents of both of which are hereby incorporated by reference herein in their entireties.

TECHNICAL FIELD

The present disclosure relates to a laundry treating apparatus.

BACKGROUND

Generally, a laundry treating apparatus may refer to an apparatus for washing laundry, an apparatus for drying laundry, and/or an apparatus for performing washing and drying of laundry.

In the laundry loading apparatus of a front loading type (also known as drum washing machine) for inputting laundry to the laundry treating apparatus in front of the laundry treating apparatus, an laundry inlet provided for receiving the laundry is formed at a lower position than a level of a waist of the user. Thus, when the user puts the laundry into the laundry treating apparatus or draws the laundry out of the laundry treating apparatus, the user needs to bend his/her back. In order to remove such inconvenience, there was a conventional laundry treating apparatus to increase a height of the laundry inlet by adding a drawer type pedestal to a lower portion of the front loading type laundry treating apparatus.

Furthermore, in the conventional laundry treating apparatuses, the drawer-type pedestal is means not only for supporting a bottom surface of the laundry loading apparatus of the front loading type, but also for washing laundry or drying laundry.

The laundry treating apparatus of a drawer type should only be operated when the drawer is inserted into a cabinet. While the drawer is inserted inside the cabinet, a door to open and close a tub (which is provided in the drawer) should not be open. Therefore, the conventional laundry treating apparatus of the drawer type needs a sensor for detecting whether the drawer is inserted into the cabinet, and a sensor for detecting whether the door opens the laundry inlet when the drawer is received inside the cabinet.

Further, in the conventional laundry treating apparatus in the form of the drawer, a center of gravity moves along the drawer when the drawer is withdrawn from the cabinet. For this reason, the drawer type laundry treating apparatus may be tilted toward a direction in which the drawer is drawn out. To solve this problem, there was a sensor to detect whether another object such as a washing machine is seated on a top face of the cabinet.

SUMMARY

Technical Problem

One purpose of the present disclosure is to provide a drawer type laundry treating apparatus to support an apparatus (dryer, washing machine, combined washing and drying machine, etc.) for laundry treatment, but to be capable of washing or drying the laundry.

Further, another purpose of the present disclosure is to provide a laundry treating apparatus to use a single sensor to detect whether the drawer is inserted into the cabinet to a reference position, whether the door has opened the laundry inlet inside the cabinet, and whether an object is seated on the top face of the cabinet.

Solution to Problem

One aspect of the present disclosure proposes a laundry treating apparatus comprising: a cabinet having a top face for supporting an object thereon and a front face having a front opening defined therein communicating an interior of the cabinet with an outside thereof; a drawer retractable from the cabinet through the front opening; a tub disposed inside the drawer and having a water storage space defined therein; a drum rotatably disposed in the tub to receive therein laundry; a laundry inlet defined in a top face of the tub to receive laundry to be input into the drum; a housing including a base fixed to the cabinet and positioned between the top face of the cabinet and a top face of the drawer, a first base through-hole and a second base through-hole passing through the base, and a mount fixed to the base; a lever body having a fixed end pivotably coupled to the base and a free end exposed to an outside of the housing through the second base through-hole; a body pressing portion disposed on the lever body, and exposed to an outside of the housing through the first base through-hole; a magnetic field generator fixed to the free end of the lever body to generate a magnetic field; a magnetic field sensor disposed on the drawer to sense the magnetic field generated from the magnetic field generator when the drawer is inserted into the cabinet to a predefined reference position; a contact body having one end exposed to the top face of the cabinet and the other end disposed on the mount, wherein the contact body moves towards the mount due to a load of the object when the object rests on the top face of the cabinet; a slide configured to reciprocate inside the mount when the contact body urges the slide, wherein when the object contacts the contact body, the slide moves the free end of the lever body so that a distance between the magnetic field generator and the magnetic field sensor is equal to or smaller than a reference distance, wherein when the object does not contact the contact body, the slide moves the free end of the lever body so that the distance between the magnetic field generator and the magnetic field sensor is larger than the reference distance; and a door pivotably mounted on the top face of the drawer or a top face of the tub and configured to open and close the laundry inlet, wherein when the door pivots in a direction of opening the laundry inlet while the drawer is inserted into the cabinet, the door presses the body pressing portion such that a distance between the magnetic field generator and the magnetic field sensor is larger than the reference distance.

In one implementation, the laundry treating apparatus further comprises: a driver to rotate the drum; and a controller configured to receive a control signal from the magnetic field sensor, and to operate the driver only when the distance between the magnetic field generator and the magnetic field sensor is smaller than or equal to the reference distance.

In one implementation, the slide includes: a sliding body configured to reciprocate inside the mount; and an inclined face formed on the sliding body, wherein the inclined face is configured to convert a motion of the contact body in a parallel manner to a height direction of the cabinet to the reciprocating motion of the sliding body in a parallel manner to a width direction of the cabinet or a longitudinal direction of the cabinet.

In one implementation, the apparatus further comprises a conversion portion configured for converting the reciprocating motion of the slide into a pivoting motion of the lever body, wherein the conversion portion is configured to: pivot the lever body so that the free end of the lever body moves towards the drawer when the contact body moves toward an inside of the mount; and pivot the lever body so that the free end of the lever body moves away from the drawer when the object does not contact the contact body.

In one implementation, the conversion portion includes: an actuating body protruding from the lever body toward the sliding body; and an inclined body disposed on the sliding body and in contact with the actuating body, wherein the inclined body has an inclined face configured such that the free end of the lever body moves toward the second base through-hole when the contact body moves toward the mount, and such that when the contact body moves away from the mount, the free end of the lever body moves away from the second base through-hole.

In one implementation, the apparatus further comprises at least one of: a slide guide configured for providing a movement path of the sliding body; or a contact body guide configured for providing a path of movement of the contact body.

In one implementation, the apparatus further comprises: a top face through-hole defined in the top face of the cabinet, wherein the contact body passes through the top face through-hole; a support body fixed to the top face of the cabinet to support the object, wherein the support body maintains a spacing between the object and the top face of the cabinet; and a body through-hole passing through the support body and communicate with the top face through-hole, wherein the contact body passes through the body through-hole.

In one implementation, the contact body includes: a first body positioned in the body through-hole and contacting the object; and a second body having one end contacting the first body and the other end contacting the slide.

In one implementation, the laundry treating apparatus further comprises a door pressing portion disposed on the housing, wherein the door pressing portion is configured to prevent the door from interfering with the front opening when the drawer is withdrawn from the cabinet.

In one implementation, the door pressing portion includes at least one roller rotatably fixed to the housing, wherein a distance from a top face of the cabinet to a bottom of the roller is configured to be larger than a distance from the top face of the cabinet to an edge of the front opening parallel to the top face of the drawer.

Advantageous Effects of Invention

In accordance with the present disclosure, a drawer type laundry treating apparatus to support an apparatus for laundry treatment, but to be capable of washing or drying the laundry may be realized.

Further, in accordance with the present disclosure, a laundry treating apparatus may use a single sensor to detect whether the drawer is inserted into the cabinet to a reference position, whether the door has opened the laundry inlet inside the cabinet, and whether an object is seated on the top face of the cabinet.

DETAILED DESCRIPTION

Hereinafter, a preferred embodiment of the laundry treating apparatus will be described in detail with reference to the accompanying drawings.

Figure 1:
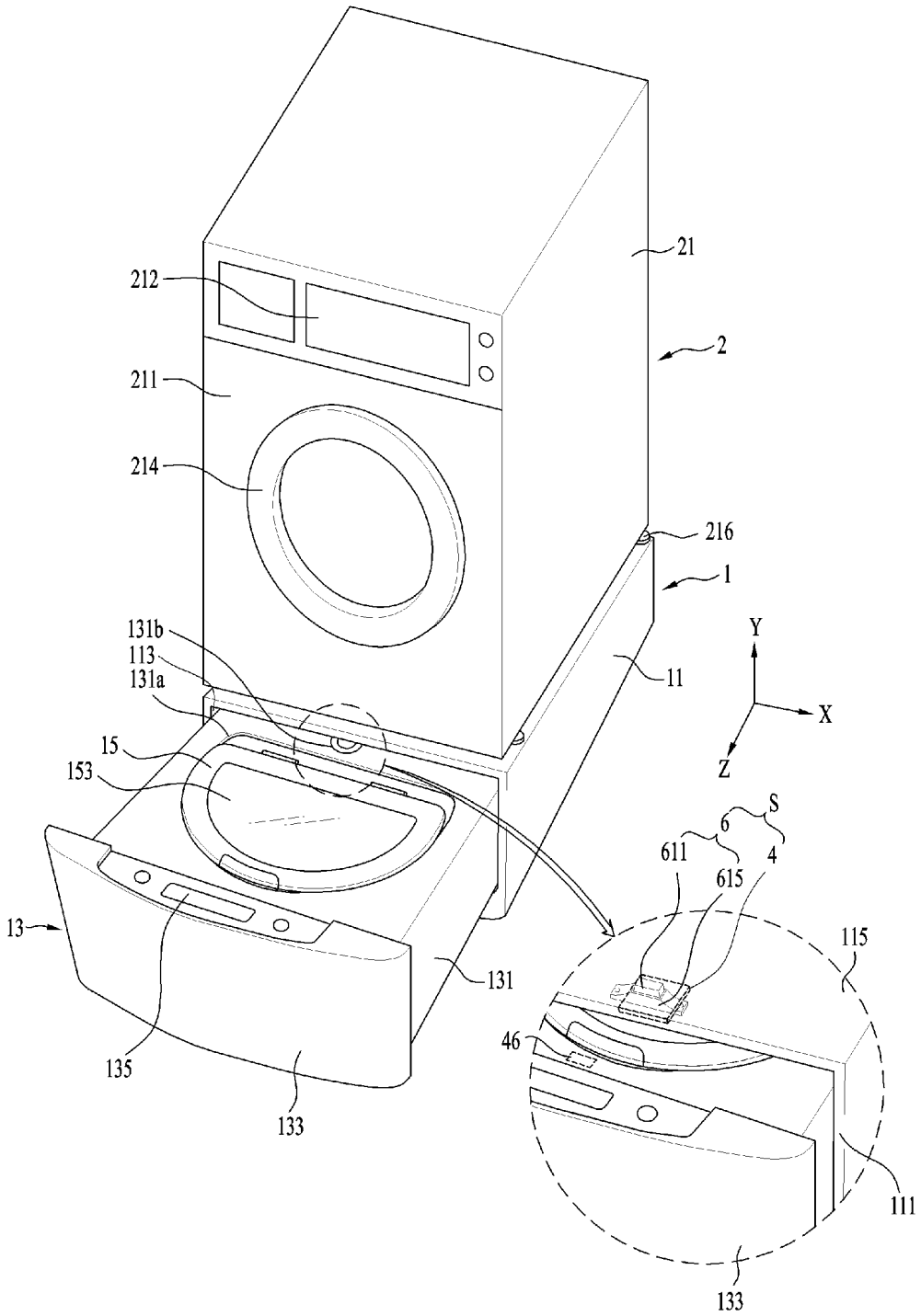
FIG. 1 and FIG. 2 show an example of a laundry treating apparatus.

As shown in FIG. 1, a laundry treating apparatus 100 may be provided as a first treating apparatus 1 capable of washing or drying the laundry as well as seating an object thereon. An object capable of resting on the first treating apparatus 1 and re-straining vibration of the first treating apparatus 1 and maintaining the center of gravity of the first treating apparatus 1 may be a second treating apparatus 2 capable of washing or drying the laundry.

The first treating apparatus 1 includes a cabinet 11 which provides a space for supporting the second treating apparatus 2 (first cabinet 11), a drawer 13 extendable from the first cabinet (a drawer retractable from the first cabinet), a tub 15 inside the drawer to provide a space for water storage (first tub 15), and a drum 17 rotatably inside the first tub to store laundry therein (first drum 17).

The first cabinet 11 may be provided in a hexahedral shape including a front face 111 with an inlet 113 and a top face 115 providing a space for receiving the second treating apparatus. The inlet 113 is provided to penetrate the front face and communicates the interior of the first cabinet 11 with the exterior thereof.

The drawer 13 includes a drawer body 131 that can be withdrawn from the first cabinet 11 through the inlet 113 or moved into the interior of the first cabinet 11, and a drawer panel 133 fixed to the drawer body 131 to open and close the inlet 113.

The drawer body 131 may be provided in a hexahedron shape. The top face of the drawer body may have a drawer first through-hole 131*a* and a drawer second through-hole 131*b* for communicating the inside of the drawer body 131 with the outside thereof.

The drawer first through-hole 131*a* may be means for feeding laundry to first drum 17. The drawer second through-hole 131*b* may be means to supply water to the first tub 15. Detailed descriptions thereof will be described later.

The drawer panel 133 is fixed to the front face of the drawer body 131 and located outside the first cabinet 11. The drawer panel 133 may act as a handle for the drawer body 131.

The drawer panel 133 may be provided in a shape capable of opening and closing the inlet 113. Opening the inlet 113 by the drawer panel 133 means that the drawer panel 133 is moved away from the front face 111 along a direction of the Z axis, thereby exposing the inlet 113 to the outside. Closing the inlet 113 by the drawer panel 133 means that the drawer body 131 is inserted into first cabinet 11 so that the inlet 113 is hidden by the drawer panel 133 and is not exposed to the outside.

The drawer panel 133 may further include a control panel 135 (first control panel 135). The first control panel 135 may include an input unit for receiving a control command from a user and a display unit for providing a user with information related to the operation of the first treating apparatus.

Figure 2:
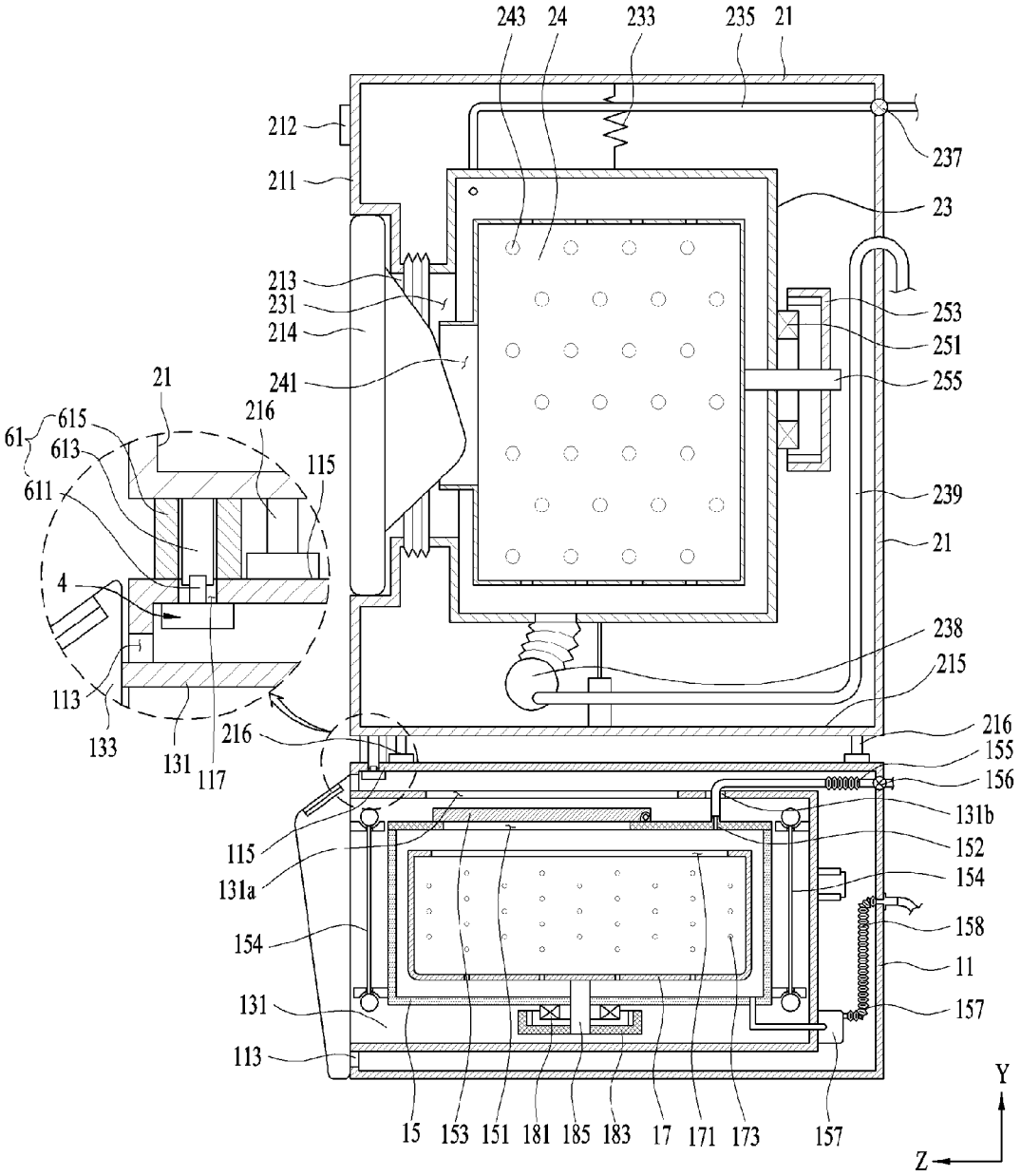

As shown in FIG. 2, the first tub 15 has a hollow cylindrical shape and may be fixed to the drawer body 131 through the first tub support 154.

The top face of the first tub 15 may have a laundry inlet 151 (first laundry inlet 151), and a supply hole 152. The first laundry inlet 151 may be preferably located below the drawer first through-hole 131*a*. The supply hole 152 may be located below the drawer second through-hole 131*b*.

The first laundry inlet 151 is opened and closed by a door 153 (first door). The first door 153 may be pivotally fixed to the top face of the first tub 15, and may be pivotally fixed to the top face of the drawer body 131. FIG. 2 shows an example where the first door 153 is coupled to the top face of the first tub 15 via a hinge. In this case, the first door 153 should be constructed to pivot away from the top face of the first tub 15 through the drawer first through-hole 131*a*.

The first tub 15 receives water through a water supply unit (first water supply unit). Water stored in the first tub 15 is discharged from the first tub via a water discharge unit (first water discharge unit).

The first water supply unit may include a first water supply pipe 155 inserted into the drawer second through-hole 131*b* to connect a water source (not shown) and the supply hole 152 with each other, and a first valve 156 to open and close the first water supply pipe 155 under control of a controller (not shown) (first controller). The first water discharge unit is configured to include a first water discharge pipe 158 which directs the water inside the first tub 15 to the outside of the first cabinet 11 and a first pump 157 which causes the water to move along the first water discharge pipe.

The drawer body 131 is configured to be movable along the longitudinal direction (Z axis) of the first cabinet 11. Thus, the first water supply pipe 155 and the first water discharge pipe 158 may be configured as a pipe having a varying length.

The first drum 17 may have a hollow cylindrical shape. The top face of the first drum includes a first drum laundry inlet 171 communicating with the first laundry inlet 151, and a communication hole 173 configured to penetrate the circumferential and bottom surfaces of the first drum. The first drum laundry inlet 171 is located under the first laundry inlet 151. Thus, the user may input the laundry to the first drum 17 through the drawer first through-hole 131*a*, first laundry inlet 151, and first drum laundry inlet 171.

The communication hole 173 may act as means for communicating the interior of the first drum 17 with the first tub 15. Thus, the water supplied to the first tub 15 is supplied to the laundry inside the first drum through the communication hole 173. Water and foreign matter remaining in the laundry may be discharged to the first tub 15 through the communication hole 173.

The first drum 17 rotates by a first driver. FIG. 2 shows an example where the first driver has a first stator 181, a first rotor 183 and a first rotation shaft 185. The first stator 181 act as means which is fixed to the bottom of the first tub 15 and forms a rotation field when current is applied thereto. The first rotor 183 may act as means for rotating by the magnetic field. The first rotation shaft 185 is configured to penetrate the bottom of the first tub and acts as means for connecting the first drum 17 and the first rotor 183.

The second treating apparatus 2 may include a second cabinet 21 located on a top of the first cabinet 11, a second tub 23 located in the second cabinet 21 to provide a space for water storage, and a second drum 24 rotatably disposed inside the second tub to store therein laundry.

The second cabinet 21 includes a front panel 211 having a second laundry inlet 213, a base panel 215 forming a bottom surface, and a leg 216 supporting the second treating apparatus 2. The second laundry inlet 213 is opened and closed by a second door 214 pivotally coupled to the front panel 211. The front panel 211 may have a second control panel 212. The second control panel may include a second input unit for receiving a control command from a user, and a second display unit for displaying information related to the operation of the second treating apparatus. Each of the legs 216 may be provided at each corner of the base panel 215 and may be seated on the top face 115 of the first cabinet.

The second tub 23 has a hollow cylindrical shape and has a second tub laundry inlet 231 communicating with the second laundry inlet 213 and defined in a front face thereof. The second tub laundry inlet 231 and the laundry inlet 213 may be connected to each other through a gasket provided in a form of a flexible pipe. This may prevent the water inside the second tub from draining into the second cabinet, and prevent the vibration of the second tub from being transmitted to the second cabinet.

The second tub 23 is secured inside the second cabinet 21 via a second tub support 233. The second tub support 233 may have a damper for fixing a lower part of the second tub to the base panel 215 and a spring for fixing an upper part of the second tub to the second cabinet 21.

The second tub 23 receives water through a second water supply unit. The second water supply unit may be configured to include a second water supply pipe for connecting water source to the second tub 23, and a second valve 237 which opens and closes the second water supply pipe 235 according to a control signal of a second controller (not shown).

The water stored in the second tub 23 is discharged out of the second cabinet 21 through the second water discharge unit. The second water discharge unit may be configured to include a second water discharge pipe 239 that directs the water inside the second tub 21 to the outside of the second cabinet 21, and a second pump 238 that causes the water to move along the second water discharge pipe 239.

The second drum 24 has a hollow cylindrical shape. In a front face thereof, there is defined a second drum laundry inlet 241 communicating with the second laundry inlet 213 of the second cabinet via the second tub laundry inlet 231. Further, the circumferential face, front face and rear face of the second drum 24 may have communication holes 243 for communicating the inside of the second drum with the inside of the second tub.

The second drum 24 is rotated by a second driver. The second driver may have a second stator 251 that is fixed to the back of the second tub to form a rotation magnetic field, a second rotor 253 rotatable by the field, and a rotation shaft 255 passing through the back face of the second tub and connecting the second drum 24 and the second rotor 253 with each other.

The embodiment as described above is based on the case where the second treating apparatus 2 is provided as an apparatus for washing laundry. The second treating apparatus 2 may be provided as an apparatus capable of drying laundry.

In this case, the second treating apparatus 2 may include a circulating duct which provides a flow path for drawing the air inside the second tub 23 to the outside and then resupplying the air to the second tub, a fan provided inside the circulating duct, and a heat exchanger that sequentially performs dehumidification and heating of the air introduced into the circulating duct.

In one example, the second treating apparatus 2 may be provided as an apparatus for the purpose of drying laundry. In this case, the second laundry treating apparatus 2 may be configured to include a second cabinet, a second drum rotatably provided inside the second cabinet, a circulating duct providing a flow path for supplying air to the second drum, a fan disposed inside the circulating duct, and a heat exchanger.

The flow path for supplying air to the second tub may include an exhaust duct for guiding air inside the second tub to the outside of the second cabinet and a supply duct for supplying air from an outside of the second cabinet to the second tub. In this case, the fan may be provided in the exhaust duct. The heat exchanger may be provided in the supply duct.

The laundry treating apparatus 100 may further include an integrated sensing unit which detects whether the drawer 13 has been inserted into the first cabinet 11 up to a preset reference position, whether the first door 153 has opened the first laundry inlet 151 inside the first cabinet 11, and whether an object (second treating apparatus) is seated on the top face of the first cabinet 11.

Figure 3:
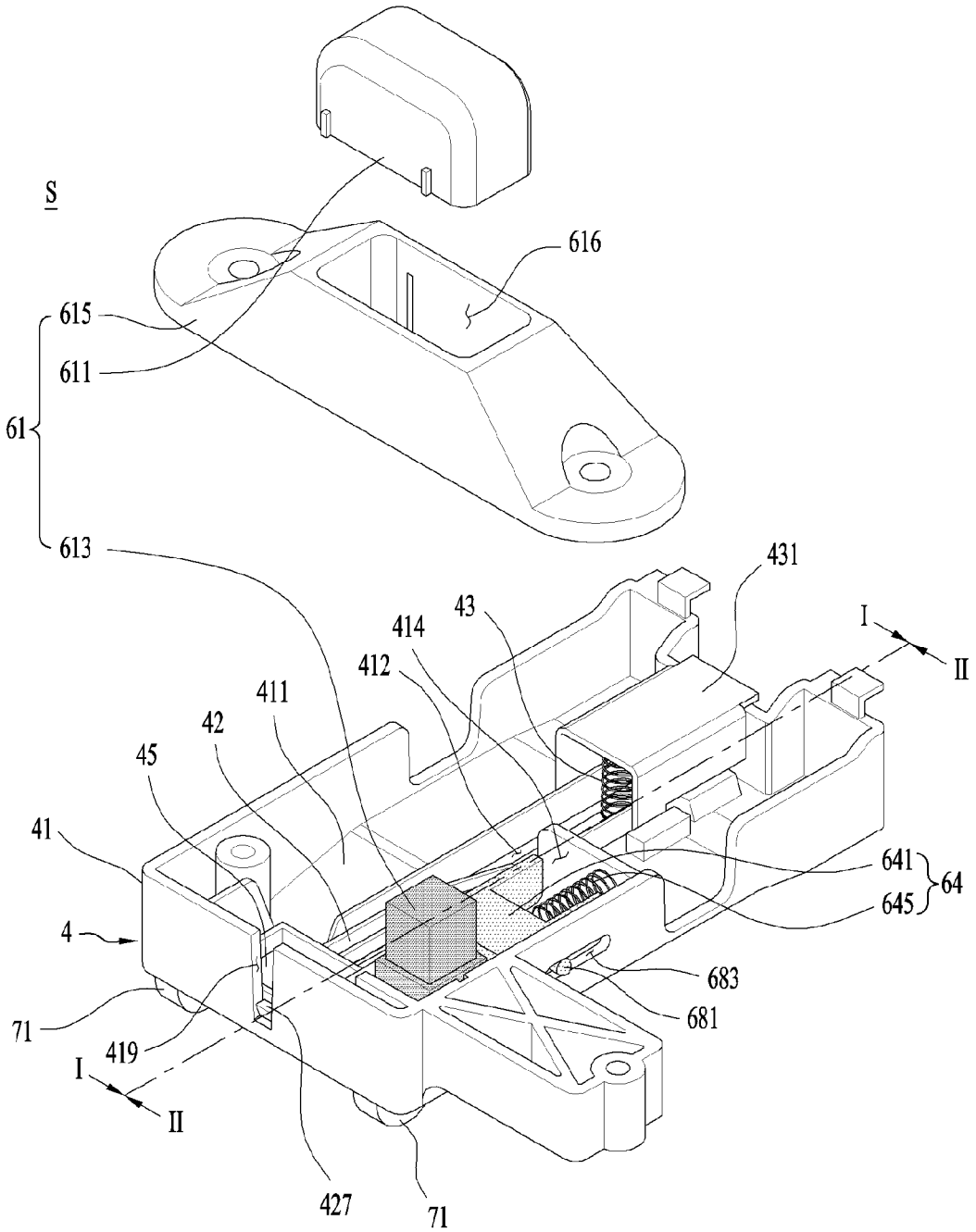
FIG. 3 and FIG. 4 illustrates an example of an integrated sensing unit provided in a laundry treating apparatus.

As shown in FIG. 3, the integrated sensing unit S includes a signal generator 4 that generates a control signal, and a lever actuator 6 which causes the signal generator 4 to generate different control signals depending on whether the second treating apparatus 2 is seated on the top face 115 of the first cabinet and whether the first door 153 has opened a first laundry inlet 151 inside the first cabinet.

The signal generator 4 includes a housing 41 provided inside the first cabinet 11, a lever 42 having one end pivotally fixed to the housing and a free end positioned between the top face 115 of the first cabinet and the top face of the drawer body 131, a magnetic field sensor 45 fixed to one of the lever 42 and the top face of the drawer body 131, a magnetic field sensor 46 (see FIG. 1) provided on the other of the lever 45 and the top face of the drawer body 131.

The magnetic field generator 45 may act as means for generating a magnetic field like a permanent magnet. The magnetic field sensor 46 may act as means for detecting the magnetic field provided by the magnetic field generator, such as the Hall sensor. FIG. 3 shows one example where the magnetic field generator 45 is mounted on the lever 42 while the magnetic field sensor 46 is fixed to the drawer body 131.

Figure 4:
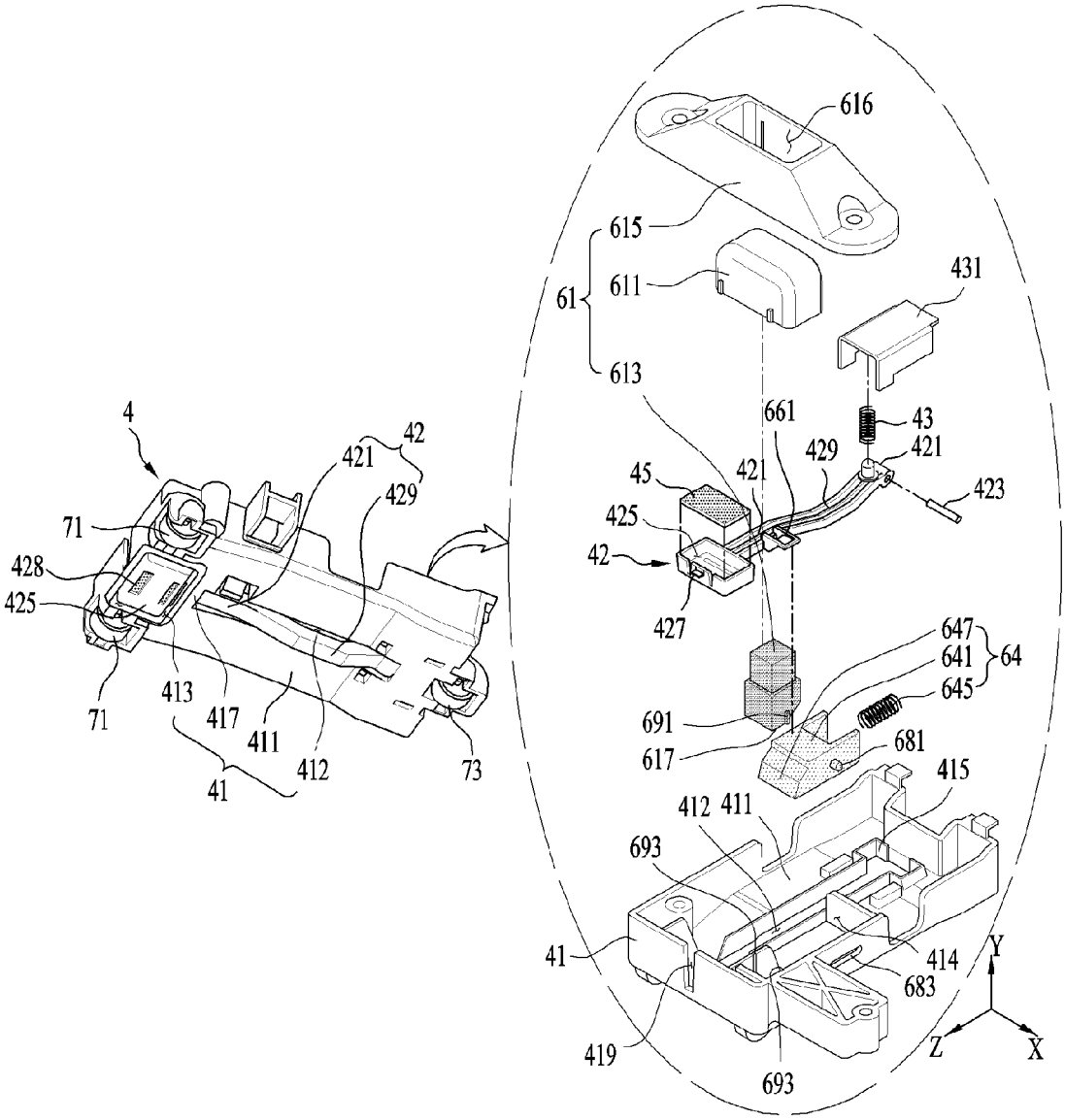

As shown in FIG. 4, the housing 41 may include a based secured to the first cabinet and located between the top face 115 of the first cabinet and the top face of the drawer body 131, a first base through-hole 412 and a second base through-hole 413 configured to penetrate the base 411, and a lever actuator mounted portion 414, which is fixed to the base and provides a space in which the lever actuator 6 is mounted.

The lever 42 may be implemented in a form of a bar pivotally fixed to the base 411. In this case, the base 411 includes a shaft receiving portion 415 in which a rotation shaft of the lever 42 is rotatably fixed, and a lever support 417 located between the first base through-hole 412 and the second base through-hole 413 to support the lever 42.

The lever 42 may include a bar shaped lever body 421 having a fixed end and a free end, and a lever rotation shaft 423 provided at the fixed end of the lever body 421, and a receiving portion 425 disposed at the free end of the lever body 421. The magnetic field generator 45 is fixed to the portion 425.

The fixed end of the lever body 421 is pivotally fixed to the shaft receiving portion 415 via the lever rotation shaft 423. The receiving portion 425 is exposed to the outside of the housing 41 through the second base through-hole 413.

The lever body 421 has a body pressing portion 429 which is exposed to the outside of the housing 41 through the first base through-hole 412. The body pressing portion 429 may be constructed by bending the lever body 421 toward the first door 153 located below the housing 41.

The body pressing portion 429 is disposed between the lever rotation shaft 423 and the receiving portion 425 and is located above the first door 153. When the first door 153 opens the first laundry inlet 151 inside the first cabinet 11, the body pressing portion 429 is configured to contact the first door 153. Thus, the lever body 421 is configured to pivot in a direction away from the top face of the drawer body 131 (toward the top face of the first cabinet) when the first door 153 pivots in the direction that the first door 153 opens the first laundry inlet 151 inside the first cabinet 11.

To facilitate the lever body 421 to pivot away from the drawer when the first door 153 opens the first laundry inlet 151 inside first cabinet 11, the lever body 421 may further include a bent portion 429 protruding toward the first door 153. The bent portion 429 may be positioned between the lever rotation shaft 423 and the receiving portion 425 and positioned on a top of the first door 153. In this case, when, inside the first cabinet 11, first door 153 pivots in the direction of opening the first laundry inlet 151, the first door 153 will press the bent portion 429 away from the drawer.

The lever 42 may further include a lever spring 43 that presses the receiving portion 425 toward the second base through-hole 413 (pressing the free end of the lever body towards the top face of the drawer body). Therefore, when the external force input to the lever body 421 through the body pressing portion 429 disappears, the lever spring 43 will pivot the lever body until the lever body 421 contacts the lever support 417. When the lever body 421 rests on the lever support 417, the receiving portion 425 is located in the second base through-hole 413.

The lever spring 43 is fixed to the base 411 via a cover 431 which is removably fixed to the base 411. In this case, the lever spring 43 has one end secured to the cover 431 and the other end fixed to the lever body 421. The other end of the lever spring 43 fixed to the lever body 42 is preferably located between the lever rotation shaft 423 and the receiving portion 42. The cover 431 may be configured to prevent the lever rotation shaft 423 from being drawn out of the lever support 417.

The receiving portion 425 may be provided in any shape as long as the magnetic field generator 45 is received therein. FIG. 4 shows an example in which the receiving portion 425 is provided in the shape of a cube with an open top face. The receiving portion 425 may further include a receiving portion through-hole 428. Through the receiving portion through-hole 428, the magnetic field from the magnetic field generator 45 is discharged out of the receiving portion 425.

To guide the pivoting motion of the lever body 421, the lever 42 may be provided with a lever guide 427 protruding from the receiving portion 425, while The housing 41 may be provided with a guide groove 419 which provides a path of movement of the lever guide 427. FIG. 4 shows one example where the lever guide 427 is provided in front of the receiving portion 425, while the guide groove 419 is provided in a front face of the housing 41.

The lever actuator 6 has a contact portion 61 reciprocating along a height direction (Y-axis direction) of the first cabinet when the second treatment apparatus 2 is seated on the top face 115 of the first cabinet, a slide 64 reciprocating in the inside of the lever actuator mounted portion 414 when the contact portion 61 urges the slide 64, and a conversion portion 66 (see FIG. 5) to convert the reciprocating motion of the slide 64 to the pivoting motion of the lever body 421.

The contact portion 61 includes contact bodies 611 and 613 moving towards the interior of the first cabinet due to the load of the second treatment apparatus 2 when the second treatment apparatus 2 rests on the top face 115 of the first cabinet, and a support body 615 that is fixed to the top face 115 of the first cabinet and supports legs 216 or a base panel 215 provided in the second treatment apparatus 2.

The support body 615 acts as means for maintaining a gap between the top face 115 of the first cabinet and the second treatment apparatus 2. The support body 615 has a body through-hole 616 through which the contact body passes. The body through-hole 616 communicates with a top face through-hole 117 (see FIG. 2) defined in the top face of the first cabinet.

One end of each of the contact bodies 611 and 613 may be exposed to the top face 115 of the first cabinet through the top face through-hole 117 and body through-hole 616, while the other end thereof may be embodied as a bar in contact with a slide 64 located inside the lever actuator mounted portion 414. The contact bodies may be implemented into a single bar. Alternatively, the contact bodies may be implemented in two bars in a combined form. FIG. 4 shows an example in which the contact bodies are implemented in a combined manner of a first body 611 inserted into the body through-hole 616, and a second bar 613 with one end fixed to the first body and the other end contacting the slide 64.

The lever actuator 6 provided in the laundry treating apparatus may further include a contact body guide for providing a movement path of the contact bodies 611 and 613. The contact body guide may include a contact body protrusion 691 on the second body 613, and a contact body protrusion receiving groove 693 formed in the housing 41 and in a height direction (Y axis direction) of the first cabinet to provide a path of movement of the contact body protrusion.

The slide 64 includes a sliding body 641 that is reciprocating in the lever actuator mounted portion 414 along a width direction (X axis direction) or length direction (Z axis direction) of the first cabinet, and a slide spring 645 which presses the sliding body 641 toward the second body 613 such that the sliding body 641 remains in contact with the second body 613.

The lever actuator 6 may be include a slide guide for providing a movement path of the sliding body 641. The slide guide may include a slide protrusion 681 formed on the sliding body 641, and a slide protrusion receiving groove 683 defined in the housing 41 along the width direction (X axis direction) or longitudinal (Z axis) direction of the first cabinet to provide a slide path for the slide protrusion.

In order that the reciprocating motion of the contact bodies 611 and 613 in a parallel direction to the height direction (Y-axis direction) of the first cabinet may be converted to the reciprocating motion of the sliding body 64 in a parallel direction to the longitudinal direction of the first cabinet or to the width direction of the first cabinet, a bottom of the second body 613 has a contact body inclined face 617 (a first inclined face), while a top face of the sliding body 641 has a slide inclined face 647 (a second inclined face). The first inclined face 617 and second inclined face 647 remain in contact with each other due to the presence of the slide spring 645.

The conversion portion 66 is configured to pivot the lever body 421 so that the distance between the receiving portion 425 and the drawer body 131 is smaller when the contact bodies 611 and 613 moves toward the inside of the lever actuator mounted portion 414. The conversion portion 66 is configured to pivot the lever body 421 so that the distance between the receiving portion 425 and the drawer body 131 is larger when the contact bodies 611 and 613 move away from the mounted portion 414.

Figure 5:
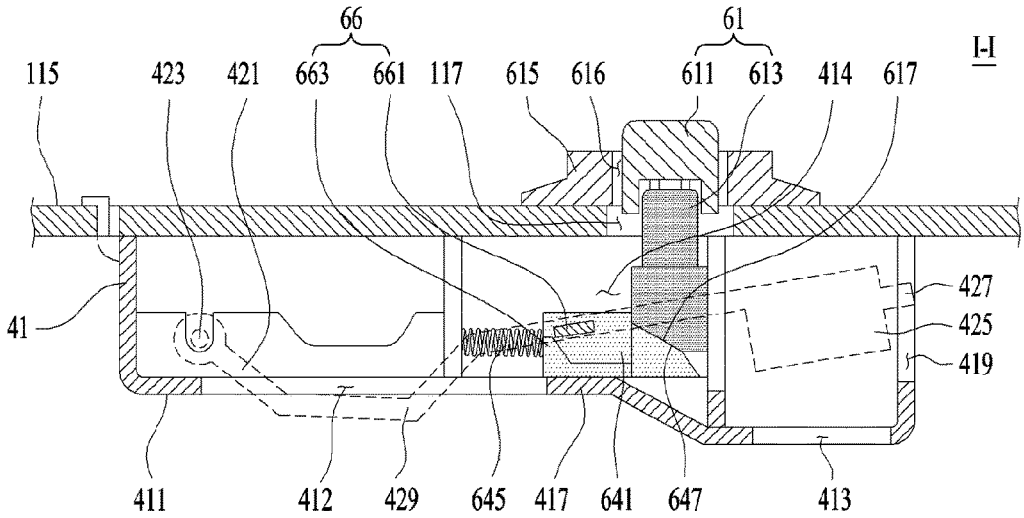
FIG. 5 and FIG. 6 show positions of a signal generator a lever actuator when no object is seated on a top face of a cabinet.

As shown in FIG. 5, the conversion portion 66 may include an actuating body 661 protruding from the lever body 421 toward the sliding body 641, and an inclined body 663 disposed on the sliding body 641 and being in contact with the actuating body 661.

In this case, the inclined body 663 may be implemented to have an inclined face configured such that the receiving portion 425 moves toward the second base through-hole 413 when the contact bodies 611 and 613 move towards the lever actuator mounted portion 414, and such that the receiving portion 425 moves away from the second base through-hole 413 when the contact bodies 611 and 613 move away from the lever actuator mounted portion 414.

Thus, when the second treatment apparatus 2 rests on the support body 615, the contact bodies 611 and 613 are moved towards the lever actuator mounted portion 414 by the leg 216 or base panel 215 of the second treatment apparatus. Thus, the sliding body 641 moves in a direction of compressing the slide spring 645 due to the first inclined face 617 and second inclined face 647. Thus, the lever body 421 will pivot in a direction such that the distance between the receiving portion 425 and the second base through-hole 413 is smaller due to the conversion portion 66.

However, when the second treatment apparatus 2 is separated from the support body 615 (when an external force supplied to the contact body is removed), the sliding body 641 is moved towards the second body 613 due to the sliding spring 645. Then, the contact bodies 611 and 613 move away from the lever actuator mounted portion 414 due to the first inclined face 617 and second inclined face 647. Thus, the lever body 421 will pivot in a direction such that a distance between the receiving portion 425 and the second base through-hole 413 is larger.

Hereinafter, an operation of the integrated sensing unit S will be described with reference to FIGS. 5 to 10.

As shown in FIG. 5, when an object such as the second treatment apparatus 2 does not rest on the top face 115 of the first cabinet, no external force will be input into the first body 611 of the contact body. Thus, the slide spring 645 causes the sliding body 641 to be pressed against the second body 613 of the contact body. Thus, the first body 611 remains exposed to the top face 115 of the first cabinet.

Further, when the sliding body 641 is pressed towards the second body 613 of the contact body, the actuating body 661 of the conversion portion will rise up along the inclined face of the inclined body 663. Thus, the receiving portion 425 disposed at the free end of the lever body 421 will move away from the second base through-hole 413.

Figure 6:
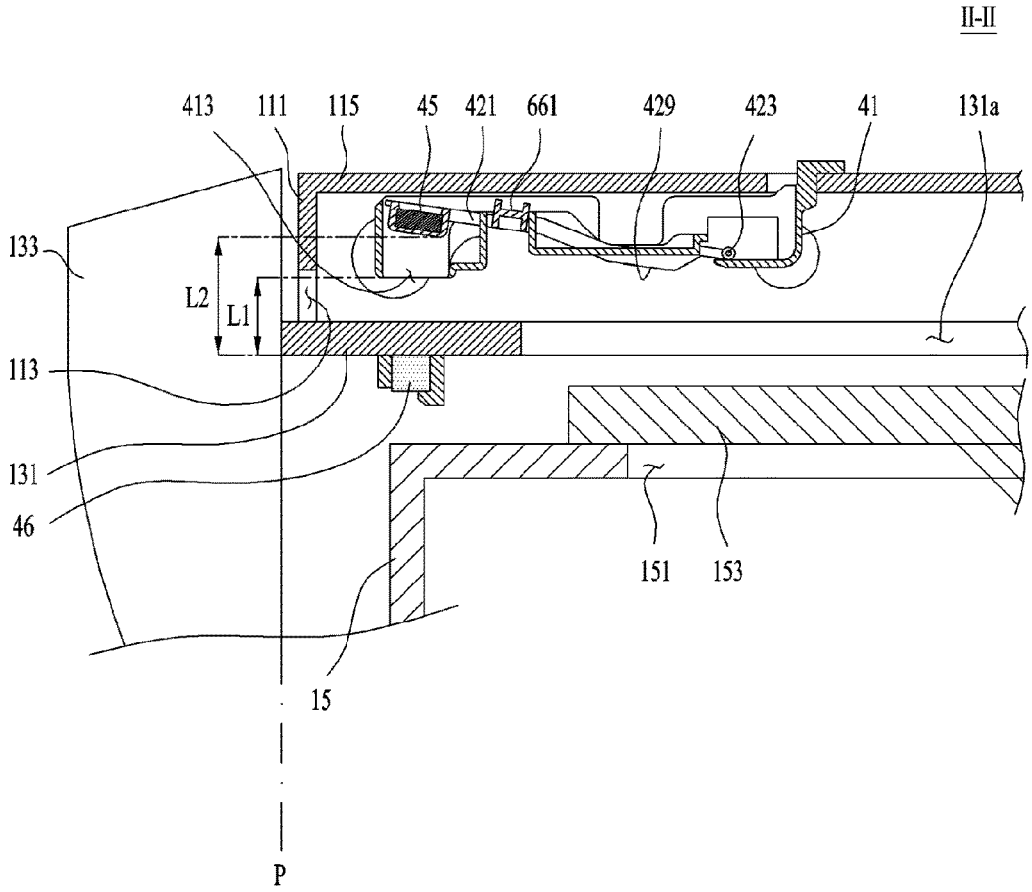

That is, as shown in FIG. 6, when an object such as the second treatment apparatus 2 does not rest on the top face 115 of the first cabinet, a distance L2 between the magnetic field generator 45 and the magnetic field sensor 46 will remain to be larger than a reference distance L1 even when the drawer body 131 moved to a reference position P. Thus, the magnetic field sensor 46 will detect a magnetic field of an intensity smaller than a reference intensity as detected by the sensor 46 when the magnetic field generator 45 is within the reference distance.

The reference position P may be set to a position at which the magnetic field sensor 46 detects a magnetic field of the reference intensity higher than the reference intensity (or a position at which the distance between the magnetic field generator and the magnetic field sensor is smaller than or equal to the reference distance L1). In this connection, the position at which the drawer panel 133 closes the opening 113 may be an example of the reference position.

Figure 7:
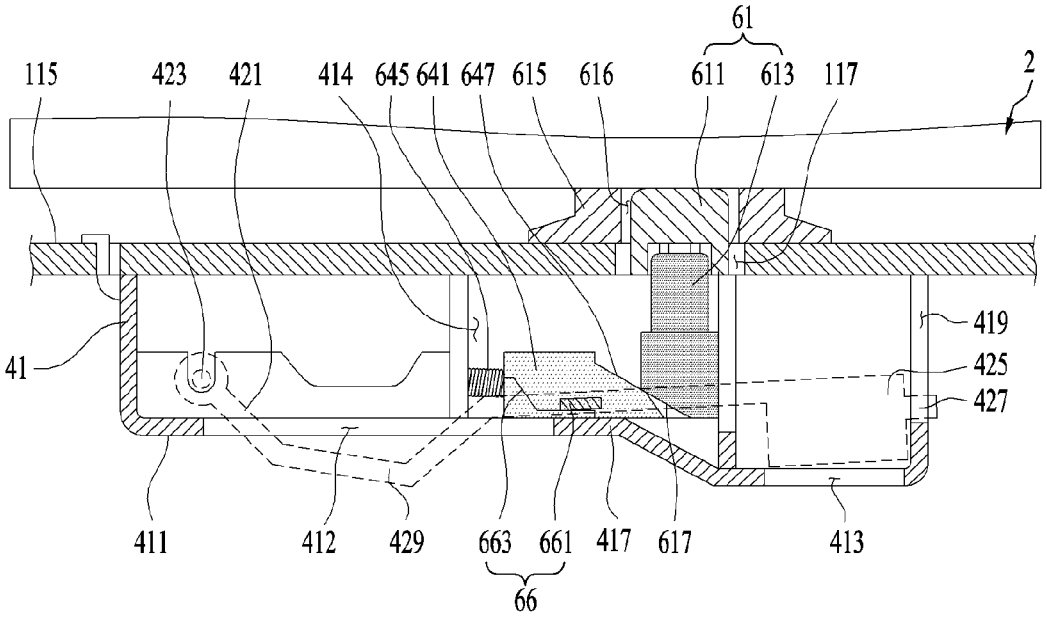
FIG. 7 and FIG. 8 show positions of the signal generator and lever actuator when an object rests on the top face of the cabinet.

However, as shown in FIG. 7, when the second treatment apparatus 2 rests on the top face 115 of the first cabinet and thus the first body 611 is pressed toward the lever actuator mounted portion 414, the sliding body 641 is moved away from the second body 613 due to the first inclined face 617 and second inclined face 647. When the sliding body 641 moves away from the second body 613 (such that the slide spring is compressed), the actuating body 661 will descend along the inclined face of the inclined body 663. Thus, the receiving portion 425 will move toward the second base through-hole 413.

Figure 8:
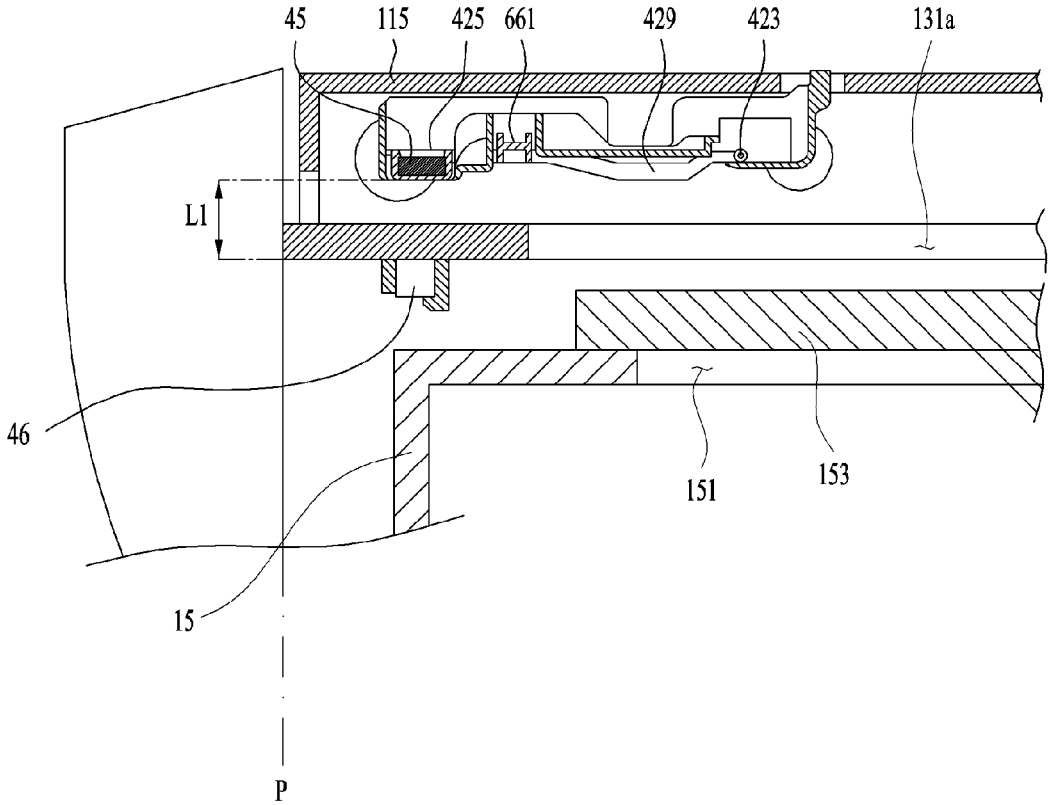

Thus, as shown in FIG. 8, when the second treatment apparatus 2 sits on the top face 115 of the first cabinet, the distance between the magnetic field generator 45 and the magnetic field sensor 46 maintains the reference distance L1. Thus, the magnetic field sensor 46 will detect the magnetic field of the reference intensity.

In this state, when the first door 153 pivots in the direction of opening the first laundry inlet 151, the lever body 421 pivots away from the top face of the drawer body 131.

Figure 9:
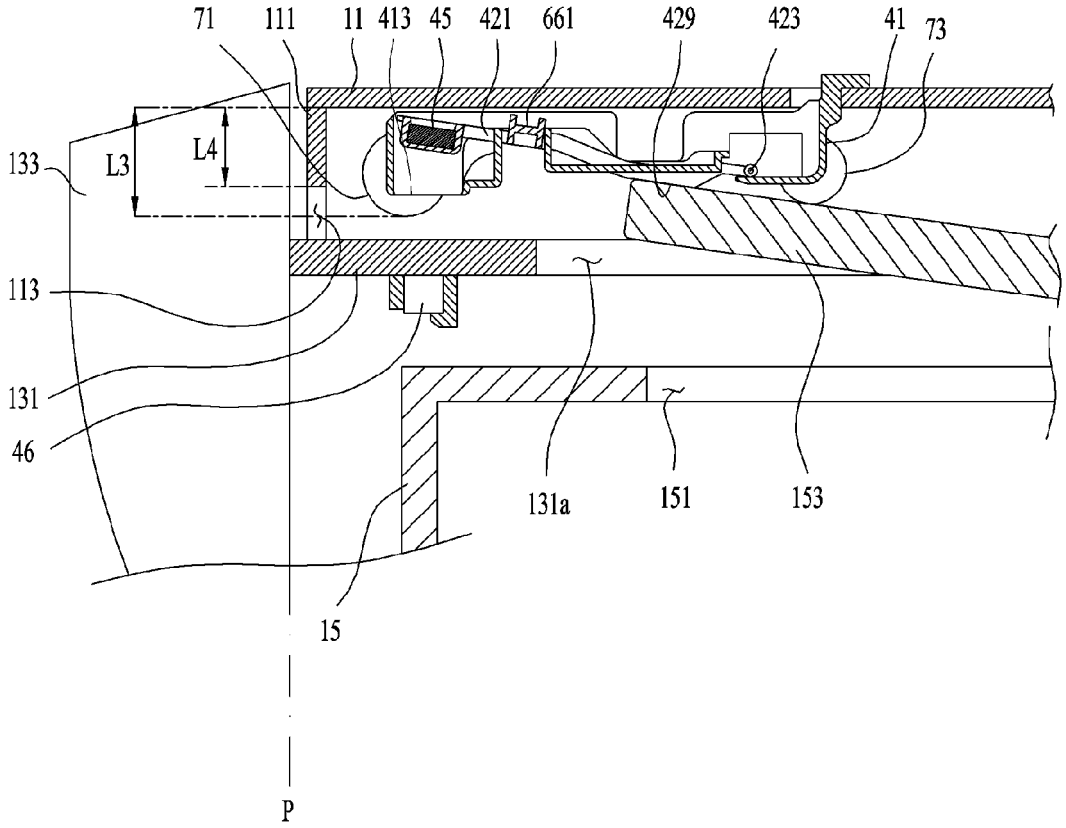
FIG. 9 and FIG. 10 show positions of the signal generator and lever actuator when a door opens an laundry inlet inside a cabinet.

That is, as shown in FIG. 9, when the first door 153 opens the first laundry inlet 151 while the drawer body 131 has moved to the reference position P, the first door 153 will contact the body pressing portion 429 and move the free end of the lever body 421 away from the top face of the drawer body 131.

Figure 10:
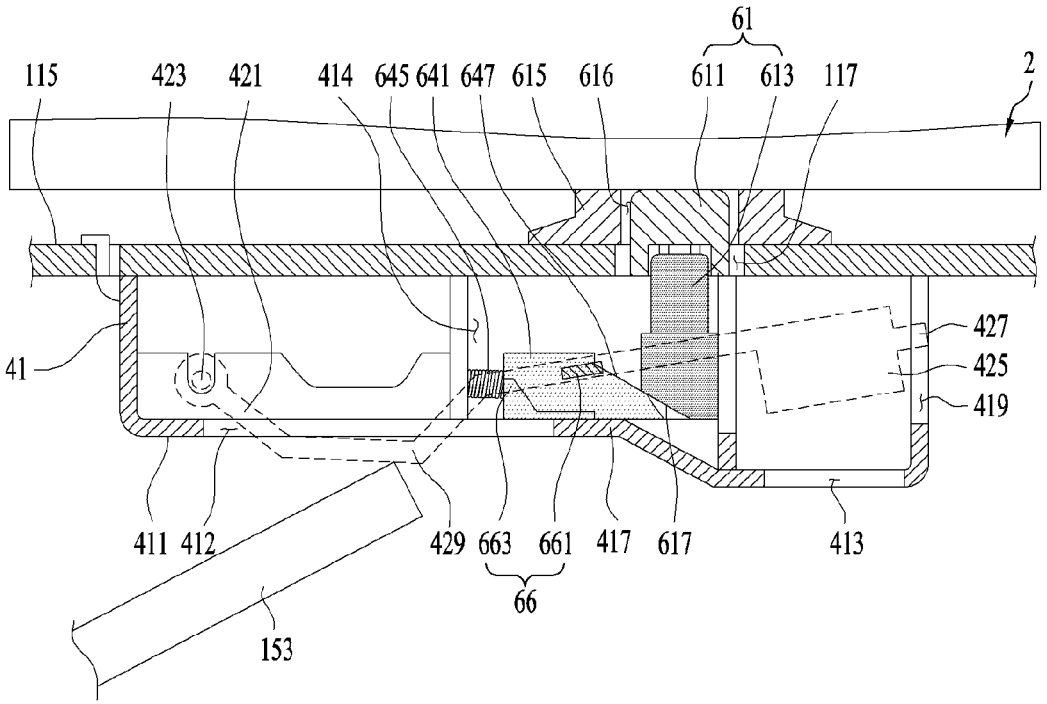

In this case, as shown in FIG. 10, the receiving portion 425 will move in a direction away from the second base through-hole 413. Thus, the distance between the magnetic field generator 45 and the magnetic field sensor 46 will remain larger than the reference distance. Thus, when the first door 153 opens the first laundry inlet 151 while the drawer body 131 has moved to the reference position P, the magnetic field sensor 46 will detect a magnetic field of an intensity lower than the reference intensity as detected when the magnetic field generator 45 is within the reference distance.

As shown in FIG. 9, when the first door 153 is opened inside the first cabinet 11, the drawer body 131 may not be drawn out of the first cabinet 11. This is because the first door 153 may interfere with the opening 113 when the drawer body 131 is withdrawn from first cabinet 11.

To solve the problem that the drawer body 131 is not drawn from the first cabinet due to the first door 153, the laundry treating apparatus 100 may further include a door pressing portion (71, 73) disposed on the housing 41 to prevent the first door 153 from interfering with the opening 113.

The door pressing portion (71, 73) may include at least one roller rotatably fixed to the housing 41. FIG. 9 shows an example in which the roller includes a first roller 71 provided in front of the housing 41 and a second roller 73 provided in rear of the housing 41.

A distance L3 from the top face 115 of the first cabinet to the bottom of each of the rollers 73 and 75 should be set to be larger than a distance L4 from the top face 115 of the first cabinet to an edge of the opening 113 (that is, an edge portion of the opening parallel to a top face of the drawer body).

In the laundry treating apparatus 100 having the above-described structure, when the first controller (not shown) receives a control signal that the magnetic field sensor 46 detects a magnetic field above a reference intensity, the first controller (not shown) may determine that the drawer body 131 has moved to the reference position P, the second treating apparatus 2 rests on the top face 115 of the first cabinet, and the first door 153 closes the first laundry inlet 151. In this state, when a user's request is input to the input unit of the first control panel 135, the first controller controls the first driver, the first valve 156, and the first pump 157 to proceed with washing of the laundry.

However, when the first controller receives a control signal that the magnetic field sensor 46 detects a magnetic field of an intensity lower than the reference intensity, the first controller notifies the user of an error message on a display unit provided in the first control panel 135. The magnetic field sensor 46 detecting a magnetic field with an intensity lower than the reference intensity may indicate that the drawer body 131 does not move to the reference position, the second treating apparatus 2 is not seated on the top face of the first cabinet, or the first door 153 is opened in the first cabinet. The error message may be of a text or sound type. Therefore, the laundry treating apparatus has an effect capable of detecting the above three states by only one magnetic field generator and one magnetic field sensor.

The laundry treating apparatus as described above may be modified and implemented in various forms. Thus, the scope of the present disclosure is not limited to the above-described embodiments.

The invention claimed is:

1. A laundry treating apparatus comprising:

a cabinet having a front face with a front opening;

a drawer retractable from the cabinet through the front opening of the cabinet;

a tub disposed in the drawer;

a drum rotatably disposed in the tub;

a laundry inlet defined at a top face of the tub;

a door pivotably mounted at a top face of the drawer or the top face of the tub for opening and closing the laundry inlet, a housing positioned between a top face of the cabinet and the top face of the drawer, wherein the housing includes a base, a first base through-hole, and a second base through-hole;

a lever having a fixed end pivotably coupled to the base, a free end positioned at the second base through-hole, and a body pressing portion positioned at the first base through-hole;

a magnetic field generator disposed at one of the free end of the lever or the top face of the drawer and configured to generate a magnetic field;

a magnetic field sensor disposed at an other of the free end of the lever or the top face of the drawer which does not include the magnetic field generator and configured to sense the magnetic field;

a contact body having a first end exposed to the top face of the cabinet and a second end disposed in the housing, wherein the contact body is configured to move up and down;

a slide having a front face configured to contact the second end of the contact body, wherein a rear face of the slide is elastically supported in the housing, and wherein the slide is configured to move back and forth when the contact body moves up and down; and a conversion portion configured to convert back and forth motion of the slide into a pivoting motion of the lever.

2. The laundry treating apparatus of claim 1, wherein the fixed end of the lever is elastically supported in the housing.

3. The laundry treating apparatus of claim 2, wherein the front face of the slide includes a first inclined face disposed at a front end of the slide, wherein the first inclined face of the slide contacts the second end of the contact body.

4. The laundry treating apparatus of claim 3, wherein the second end of the contact body includes a second inclined face corresponding to the first inclined face of the slide.

5. The laundry treating apparatus of claim 4, wherein the conversion portion includes:

an inclined body disposed on the slide and having an inclined face; and an actuating body disposed on the lever and configured to move in accordance with the inclined face of the inclined body.

6. The laundry treating apparatus of claim 5, wherein the inclined face of the inclined body is inclined in the same direction as the first inclined face of the slide.

7. The laundry treating apparatus of claim 6, wherein the inclined body is disposed at a side face of the slide and the actuating body is disposed at a side face of the lever.

8. The laundry treating apparatus of claim 7, wherein the actuating body protrudes from the lever toward the slide.

9. The laundry treating apparatus of claim 8, wherein the housing has a mount for accommodating the contact body and the slide.

10. The laundry treating apparatus of claim 9, further comprising at least one of:

a slide guide configured for guiding a movement of the slide; and a contact body guide configured for guiding a movement of the contact body.

11. The laundry treating apparatus of claim 9, further comprising a slide guide configured to guide a movement of the slide and including a protrusion disposed on the slide and an opening corresponding to the protrusion disposed on the mount.

12. The laundry treating apparatus of claim 11, further comprising a contact body guide configured to guide a movement of the contact body and including a contact body protrusion disposed on the contact body and a contact body protrusion receiving opening corresponding to the contact body protrusion disposed on the mount.

13. The laundry treating apparatus of claim 1, further comprising a support body disposed at the top face of the cabinet and configured to accommodate the contact body, wherein the support body includes a body through-hole corresponding to a top face through-hole of the top face of the cabinet.

14. The laundry treating apparatus of claim 13, wherein the contact body includes:

a first body positioned in the body through-hole of the support body; and a second body having one end contacting the first body and another end contacting the slide.

15. The laundry treating apparatus of claim 14, wherein a size of the first body is larger than a size of the second body.

16. The laundry treating apparatus of claim 1, further comprising a door pressing portion disposed on the housing, wherein the door pressing portion is configured to prevent the door from interfering with the front opening of the cabinet when the drawer is retracted from the cabinet.

17. The laundry treating apparatus of claim 16, wherein the door pressing portion includes at least one roller rotatably fixed to the housing, and wherein a lower end of the at least one roller is positioned below a top end of the front opening of the cabinet.

18. The laundry treating apparatus of claim 2, further comprising:

a driver configured to rotate the drum; and a controller configured to:

receive a control signal from the magnetic field sensor, and operate the driver when a distance between the magnetic field generator and the magnetic field sensor is smaller than or equal to a reference distance.

* * * * *